United States Patent [19]

Gilpatrick et al.

[11] 4,069,561

[45] Jan. 24, 1978

[54] SELVEDGE PROTECTION APPARATUS FOR LOOP PILE FABRIC CUTTING MACHINE

[75] Inventors: Michael William Gilpatrick, Chesnee, S.C.; Walter Engels, Tryon, N.C.

[73] Assignee: Milliken Research Corporation, Spartanburg, S.C.

[21] Appl. No.: 714,100

[22] Filed: Aug. 13, 1976

[51] Int. Cl.[2] ..... D06C 13/08

[52] U.S. Cl. ..... 26/9; 26/75

[58] Field of Search ..... 26/9, 75

[56] References Cited

U.S. PATENT DOCUMENTS

| | | | |
|---|---|---|---|
| 1,974,210 | 9/1934 | Fowler | 26/75 |
| 3,925,864 | 12/1975 | Gilpatrick | 26/9 |
| 3,931,669 | 1/1976 | Gilpatrick | 26/9 |
| 3,977,055 | 8/1976 | Gilpatrick | 26/9 |
| 3,977,056 | 8/1976 | Gilpatrick | 26/9 |
| 3,982,309 | 9/1976 | Gilpatrick | 26/9 |

*Primary Examiner*—Robert R. Mackey

*Attorney, Agent, or Firm*—Earle R. Marden; H. William Petry

[57] ABSTRACT

Apparatus to prevent the accidental cutting of the selvedge backing material of a loop pile fabric being cut by a rotating cutting apparatus. The apparatus includes a plurality of fingers which engage the selvedge to maintain it in a tensioned condition in response to an automatic control which senses the position of the selvedge of the fabric.

8 Claims, 5 Drawing Figures

SELVEDGE PROTECTION APPARATUS FOR LOOP PILE FABRIC CUTTING MACHINE

It is an object of the invention to provide a means to efficiently cut the loops of a loop pile fabric without accidental cutting of the fabric selvedge and/or the backing material.

Other objects and advantages of the invention will become readily apparent as the specification proceeds to describe the invention in which FIG. 1 is an overall schematic view of an apparatus to produce cut loop pile fabric;

Figure 1:
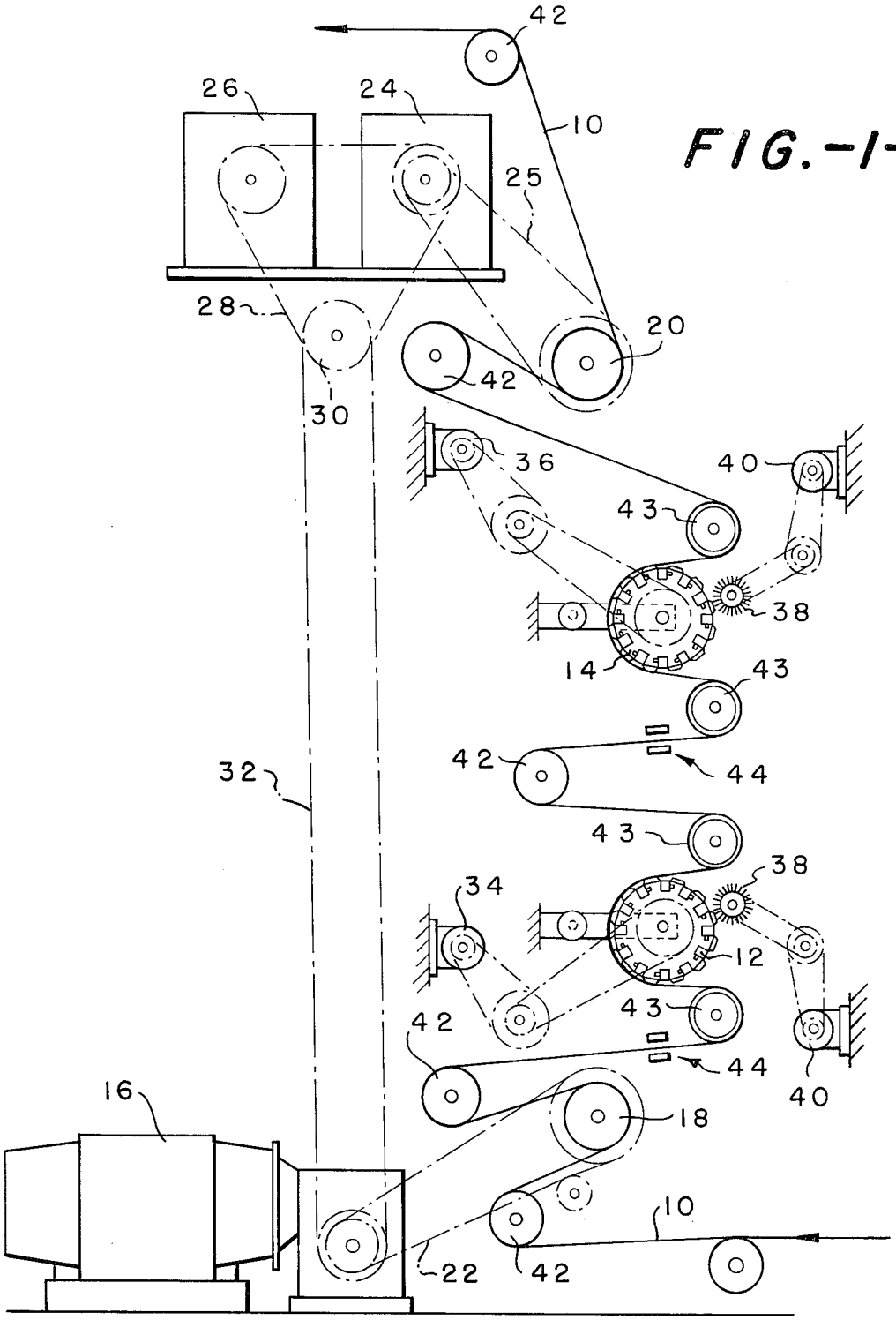

Looking now to the drawings and especially FIG. 1, the invention will be described. A loop pile fabric 10, such as tufted or bonded fabric, is supplied from a supply roll (not shown), over rotating cutting rotors 12 and 14 whereat the loops are cut, to a take-up roll (not shown). A motor unit 16 is employed to drive the roll 18 which pulls the loop pile fabric 10 from the supply and to drive the roll 20 to aid in pulling the fabric 10 through the machine.

The roll 18 is driven directly from the motor unit 16 by a suitable pulley belt 22 while the roll 20 is driven from the clutch box 24 by a pulley belt 25. Clutch boxes 24 and 26 transmit power from pulley belt 28 which is driven by sprocket 30 which in turn is driven from the motor unit 16 by pulley belt 32. Clutch box 26 transmits power to another portion of the machine which is not part of the invention.

The cutting rotors 12 and 14 are driven, respectively, by separate motors 34 and 36. Mounted adjacent each of the rotors 12 and 14 is a rotating cleaning brush 38 driven by motor 40 to clean the lint, trash and yarn from the rotors 12 and 14 deposited therein during the loop cutting operation. A plurality of idler rolls 42 and threaded guide bars 43 are employed to guide the fabric 10 through the machine. Schematically represented by reference numeral 44 are edge guide controls 46, preferably of the fluidic type, to adjust the position of the selvedge protectors 48 on each of each of the cutting rotors 12 and 14.

In the preferred form of the invention, it is desired to use at least two loop cutting rotors so that the speed of production can be increased but the number of such rotors is within the scope of the use of the apparatus and does not form part of the invention. The basic use and operation of the cutting rotors 12 and 14 is as set forth in copending U.S. patent application Ser. No. 542,111, filed Jan. 20, 1975, now U.S. Pat. No. 3,977,055 entitled "Pile Fabric Loop Cutting Apparatus" wherein is described the specific action of the cutting blades to cut the loops of a loop pile fabric to produce a cut pile product.

Each of the rotors 12 and 14 has a plurality of rows of cutting blades 50 mounted in slots in the rotors as disclosed in U.S. patent application Ser. No. 542,111, supra. Slidably mounted in notches on the collar 52 between each row of cutting blades is a selvedge protector finger 54 having a sawtooth upper surface 56 thereof angled away from the selvedge to provide a lateral pull thereon. All of the fingers 54 on any one end of the rotors are connected to a circular plate or ring 52 which rotates with its respective rotor due to its engagement with collar 58 which is driven with the rotor and rotates with respect to the stub shaft or bushing 60 via suitable bearings 62. Bushing 60 is mounted on rotor shaft 64 through a suitable sleeve bearing and is moved coaxially of the shaft 64 by piston 66 to move the selvedge protector inwardly and outwardly for reasons hereinafter explained. The piston rod 68 is fixed at 70 by means of a nut and bolt 72 while the piston 66 is fixed to the connecting member 74 which moves the bushing 60 coaxially to move the selvedge protectors 48. To stabilize the sliding movement of the selvedge protectors, the connecting member 74 also moves the bearing member 76 telescoped over the fixed rod 78. Also attached to and movable with the connecting member 74 by means of support bracket 80 is the edge guide sensor 46.

Figure 2:
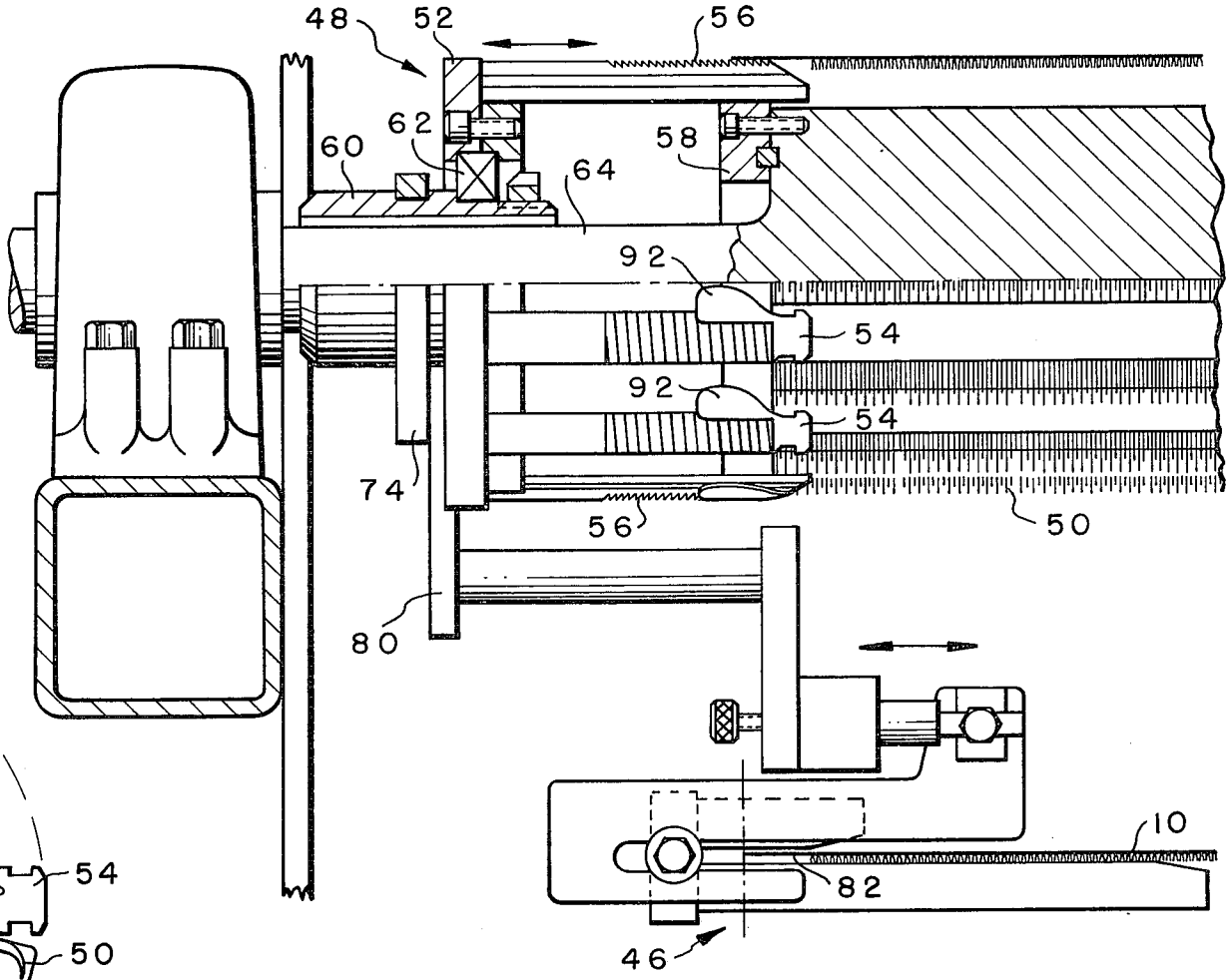
FIG. 2 is an elevation view of a partial section of one of the cutting rotors taken on line 2—2 of FIG. 3.
Figure 4:
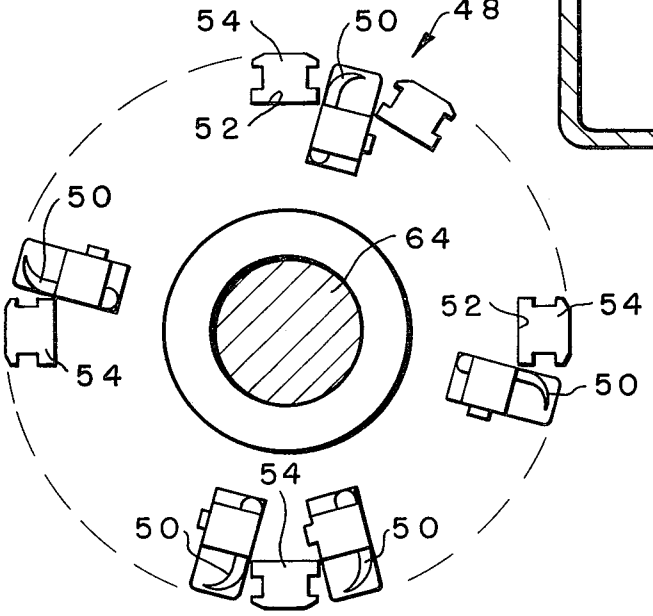
FIG. 4 is an end view of the cutting rotor taken on line 4—4 of FIG. 3.
Figure 3:
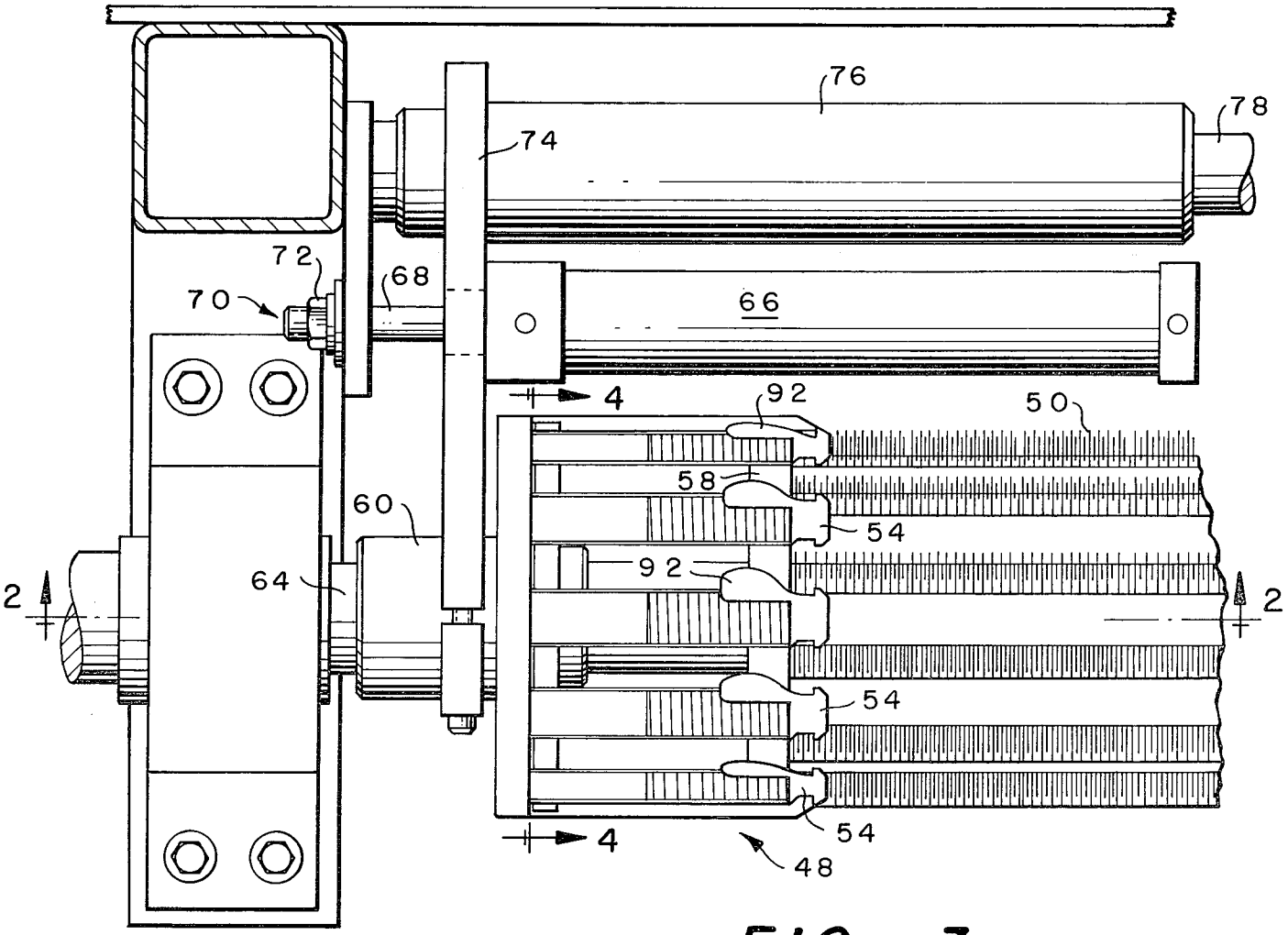
FIG. 3 is a top view of FIG. 2.
Figure 5:
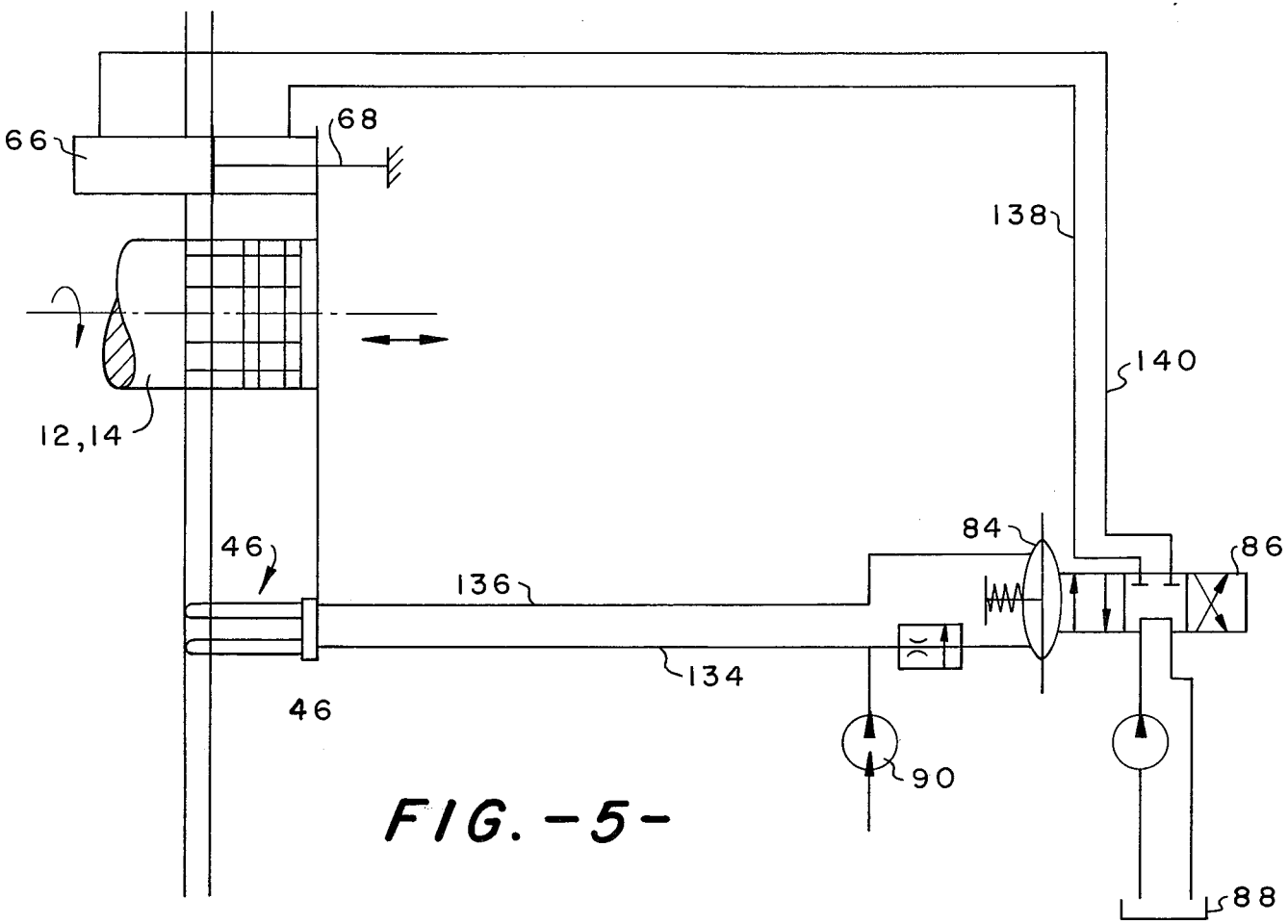
FIG. 5 is a schematic fluidic-hydraulic diagram for the edge guide sensor.

As shown in FIGS. 1 and 2, the edge guide sensor 46 is of the fluidic type and depending on the position of the selvedge 82 of the pile fabric 10, changes the pressure on the spring loaded diaphragm 84 to vary the position of the four-way valve 86. Valve 86 controls the flow of fluid from the tank 88 to the double-acting piston 66 to correctly position the selvedge protectors 48 relative to the selvedge 82 of the fabric 10 being sensed. The fluidic sensor 46 is a commercially available type which employs air from a blower 90 to provide the pressure differential to motivate the spring loaded diaphragm 84. As can be seen in FIGS. 2 and 5, the selvedge 82 is at its desired position so the valve 86 is in its blocked position so fluid from the tank merely circulates from the tank, through the valve and back to the tank. In this condition there is no flow in conduits 138 or 140. Then, if the selvedge should move to the left (FIG. 2), the flow of air from the conduit 134 will be partially blocked from the conduit 136 by the selvedge and the pressure in conduit 136 will be reduced. Reduction of the pressure in conduit 136 reduces the pressure on the left hand side of the diaphragm 84 allowing the pressure on the right hand side of the diaphragm to move the diaphragm 84 to the left causing the valve to assume the left hand position thereby supplying fluid under pressure through conduit 138. Since fluid is being exhausted through conduit 140 to the tank 88, the piston 66, and consequently the selvedge protectors 48, will move outward from the cutting rotors until the edge guide sensor 46 assumes the proper position relative to the selvedge edge 82 as shown in FIG. 2 whereat the diaphragm again assumes the position shown in FIG. 5. Conversely, if the selvedge 82 moves inward towards the rotor, the pressure in conduit 136 will increase moving the valve 86 to the right hand position causing fluid to flow in conduit 140 to move the piston 66 and selvedge protector inward until once again the selvedge edge is detected by the sensor 46. This operation automatically repeats itself depending on the position of the selvedge 82 relative to the edge sensor 46.

Integrally attached to each of the fingers 54 is a projection 92 to prevent the loop pile fabric being cut from falling down between the fingers 54 and the cutting blades during operation.

It can readily be seen that an apparatus has been described that substantially decreases the opportunity for the rotor cutting blades to cut the selvedge of a loop pile fabric being cut by the blades since the disclosed apparatus not only protects the selvedge but also tends to eliminate creases or folds in the fabric being cut.

Although the preferred embodiment of the invention has been described, it is contemplated that changes may be made without departing from the scope or spirit of the invention and it is desired that the invention be limited only by the scope of the claims.

We claim:

1. Apparatus to provide a cut loop pile fabric comprising a rotor, a plurality of rows of cutting means in said rotor, means to rotate said rotor, means to supply a loop pile fabric with a selvedge thereon into contact with said rotor with the loops of the fabric in contact with said cutting means, selvedge protection means on at least one end of said rotor between each of said rows of cutting means to hold the selvedge of the fabric out of contact with said cutting means and means operably associated with the edge of the pile fabric to automatically maintain said selvedge protection means in a predetermined position relative to the fabric being supplied to said rotor.

2. The apparatus of claim 1 wherein said selvedge protection means includes a plurality of fingers which project between said rows of cutting means.

3. The apparatus of claim 2 wherein the upper surface of said fingers are serrated to hold the selvedge of the fabric.

4. The apparatus of claim 3 wherein said serrations are inclined towards the end of said rotor to provide a camming action on the selvedge of the fabric.

5. The apparatus of claim 2 wherein said fingers are connected to a collar member and means mounting said collar member to said apparatus to cause said collar member to rotate with said rotor and allow inward and outward slidable movement relative thereto.

6. The apparatus of claim 5 wherein said means to mount said collar member includes a piston member and said means operably associated with the edge of the pile fabric comprises an edge sensing device to control the flow of fluid to said piston member.

7. Apparatus to provide a cut loop pile fabric comprising: a rotor having a shaft, a plurality of rows of cutting means in said rotor, a mounting ring connected to said rotor, a plurality of notches in said mounting ring between said rows of cutting means, a stub shaft mounted on said rotor shaft, a collar member rotatably mounted on said stub shaft, a plurality of fingers connected to said collar member and projecting through said notches in said mounting ring, means supplying a loop pile fabric with a selvedge thereon into contact with said rotor and means responsive to the position of the selvedge to slidably move said stub shaft relative to said rotor to position said fingers relative to the selvedge.

8. The apparatus of claim 7 wherein said means responsive to the position of the selvedge includes a piston member operably associated with said stub shaft.

* * * * *